United States Patent [19]

Smigel et al.

[11] Patent Number: 4,566,239

[45] Date of Patent: Jan. 28, 1986

[54] INSULATION SYSTEM

[76] Inventors: Robert L. Smigel, 700 Brick Mill Run, Westlake, Ohio 44145; Kenneth J. Paliwoda, 16937 Lanier Ave., Strongsville, Ohio 44136

[21] Appl. No.: 538,511

[22] Filed: Oct. 3, 1983

[51] Int. Cl.[4] ..... E04B 1/74

[52] U.S. Cl. ..... 52/407; 24/460; 52/309.8

[58] Field of Search ..... 52/407, 406, 404, 63, 52/222, 86, 309.8; 24/460

[56] References Cited

U.S. PATENT DOCUMENTS

| | | | |
|---|---|---|---|
| 3,496,058 | 2/1970 | Schroter et al. | 52/309.8 |
| 3,513,614 | 5/1970 | Studzinski . | |
| 3,619,437 | 11/1971 | McDonald, Jr. . | |
| 3,909,994 | 10/1975 | Richter | 52/63 |
| 4,058,949 | 11/1977 | Bellem . | |
| 4,107,826 | 8/1978 | Tysdal | 24/460 |
| 4,147,003 | 4/1979 | Alderman | 52/309.8 |
| 4,151,692 | 5/1979 | Holcombe | 52/309.8 |
| 4,172,345 | 10/1979 | Alderman | 52/406 |
| 4,189,880 | 2/1980 | Ballin | 52/222 |
| 4,379,381 | 4/1983 | Holcombe | 52/404 |

FOREIGN PATENT DOCUMENTS

| | | | |
|---|---|---|---|
| 1043654 | 12/1978 | Canada | 24/460 |
| 18006 | 10/1980 | European Pat. Off. | 52/406 |
| 2315793 | 10/1974 | Fed. Rep. of Germany | 52/407 |

OTHER PUBLICATIONS

Brochure by Mizell Bros. Co., copyright 1981.

Brochure by Johns-Manville entitled PEBS Guidebook.

*Primary Examiner*—Carl D. Friedman

*Assistant Examiner*—Creighton Smith

*Attorney, Agent, or Firm*—Yount & Tarolli

[57] ABSTRACT

An improved insulation system is used to insulate the roof of a metal building. The insulation system includes insulating boards which are suspended beneath roof panels by flexible sheets of material. The flexible sheets are attached to structural members, that is, to purlins beneath the roof panels. The flexible sheets have a width which is greater than the width of the insulating boards so that longitudinally extending edge portions of the sheets project outwardly from the edges of the insulating boards. The edge portions of the sheets are connected with the purlins at locations above the insulating boards so that the flexible sheets hang downwardly to suspend the insulating boards beneath the roof panels without compressing the insulating boards.

12 Claims, 6 Drawing Figures

INSULATION SYSTEM

BACKGROUND OF THE INVENTION

The present invention relates to an insulating system for use in a building, and more specifically to an insulating system for the roof of a metal building.

Commonly, insulation for the roof of a metal building comprises an insulating material with a covering such as vinyl or the like adhered thereto. When installed, the covering is visible and provides an attractive ceiling for the building. Also, the covering provides a vapor barrier to prevent moisture from penetrating the insulating material. As is known, moisture penetration into insulating material reduces the insulating capability of the insulating material.

The roofs of metal buildings have previously been insulated by placing blankets of insulation between the purlins and roof panels. This results in the insulating material being compressed between the purlins and the roof panels. When the insulating material is compressed between a roof panel and a purlin, the effectiveness of the insulation as a heat transfer barrier is substantially reduced. Also, because of the compression the appearance of the vapor barrier is not particularly attractive.

Certain insulating systems have been developed which do not result in compression of the insulating material. These systems, however, require various techniques for supporting the insulation in place such as straps, structural parts, etc. These systems are complex to install and cannot effectively be used to add insulation to an existing building.

SUMMARY OF THE PRESENT INVENTION

The present invention provides a new and improved insulation system for the roof of a building. The insulation system utilizes a suitable insulating material and a vapor barrier which protects the insulating material from moisture penetration and provides an attractive ceiling appearance.

The insulation system includes elongated bodies of insulating material, such as insulating boards or fiberglass, which are suspended from the purlins by flexible sheets of material which form the vapor barrier. The flexible sheets have widths which are greater than the width of the insulating material so that edge portions of the sheets extend outwardly from opposite sides of the insulating material. The edge portions of the sheets are connected with the purlins by connector assemblies.

Each connector assembly includes a support member which is fixedly connected with a purlin at a location above the insulating material. The support member is disposed on a side of the sheet opposite from the insulating board to enable the support member to be connected directly to a purlin. The support member cooperates with a connector member associated with the vapor barrier to secure the vapor barrier to the purlin. In one specific instance, the connector includes a pair of clamp members which grip opposite sides of the vapor barrier.

Accordingly, it is an object of this invention to provide a new and improved insulating system wherein bodies of insulating material are suspended beneath a roof panel by the vapor barrier which is connected with structural members without compressing the insulating material.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
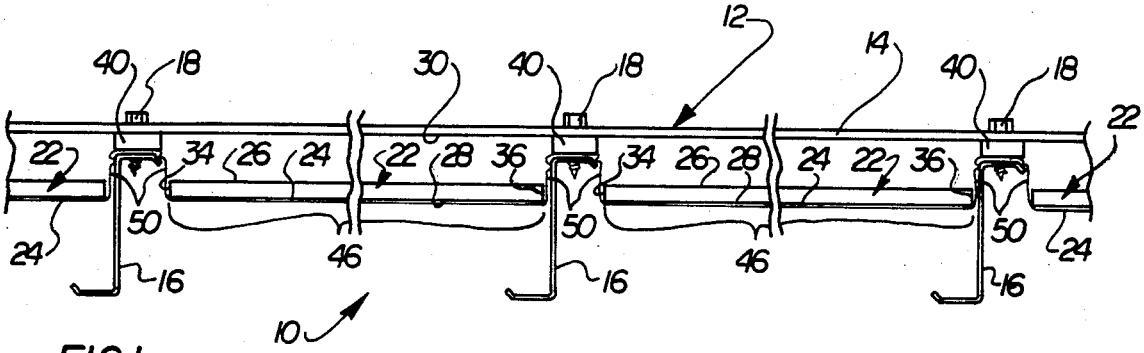
FIG. 1 is a fragmentary sectional view illustrating the relationship between roof panels, purlins, and an insulation system constructed in accordance with the present invention.

An insulation system 10 for insulating the roof 12 of a metal building is shown in FIG. 1. The roof 12 includes a metal roof panel 14 which is connected with longitudinally extending metal structural members or purlins 16 by suitable fasteners 18. Although only a portion of the roof 12 of the metal building has been shown in FIG. 1, it should be understood that the entire roof has the same general construction and is connected with metal walls of the building in a known manner.

The insulation system 10 includes a plurality of elongated bodies of insulating material, such as insulating boards 22. Other insulating material could also be used such as fiberglass. The rigid insulating boards 22 are suspended from the purlins 16 by flexible sheets 24. The flexible sheets 24 support the insulating boards 22 with their upper and lower major side surfaces 26 and 28 extending parallel to a lower side surface 30 of the roof panel 14. In addition to supporting the insulating boards 22, the flexible sheet 24 forms a vapor barrier to protect the insulating material from moisture.

The insulating boards 22 have a width (shown in FIG. 1) which is slightly less than the distance between adjacent purlins 16. The insulating boards 22 have longitudinally extending edge portions 34 and 36 which extend parallel to the longitudinal central axes of the purlins 16 and the longitudinal central axes of the sheets 24. Since the upper major side surfaces 26 of the insulating boards 22 are spaced from the bottom surface 30 in the roof panel 14 (see FIG. 1) a blanket of insulating material can be placed in the space between the insulating boards 22 and the roof panel if desired. If this is done, the flexible sheet 24 would support both the insulating boards 22 and the separate blankets of insulating material.

In order to provide for insulation between the purlin 16 and the roof panel 14, a block of insulating material 40 is disposed between the horizontal upper section 42 (see FIG. 2) of the purlin 16 and the roof panel 14. A suitable known fastener and clip construction 18 secures the block 40 in engagement with the upper section 42 of the purlins 16. The insulating material 40 has sufficient strength to resist the compression forces applied to it when the fastener 18 is tightened to thereby preserve the insulating characteristics of the material 40.

A separate sheet 24 is provided between each pair of purlins 16. Each flexible sheet 24 has a width which is greater than the distance between adjacent purlins 16. The width of a sheet 24 is also greater than the width of an insulating board 22 by a distance which exceeds twice the thickness of an insulating board to enable the sheet to extend upwardly past the upper side surface 26 of an insulating board. Each sheet 24 has a length which is equal to the length of an insulating board. However, a sheet 24 could have a length which is equal to the length of a plurality of insulating boards 22 if desired.

Each of the sheets 24 includes a central portion 46 (FIG. 1) which is secured by adhesive to the lower side surface 28 of an insulating board 22. The central portion 46 of a sheet 24 in an installed insulation system 10 extends generally horizontal to provide an attractive ceiling for the building.

Figure 2:
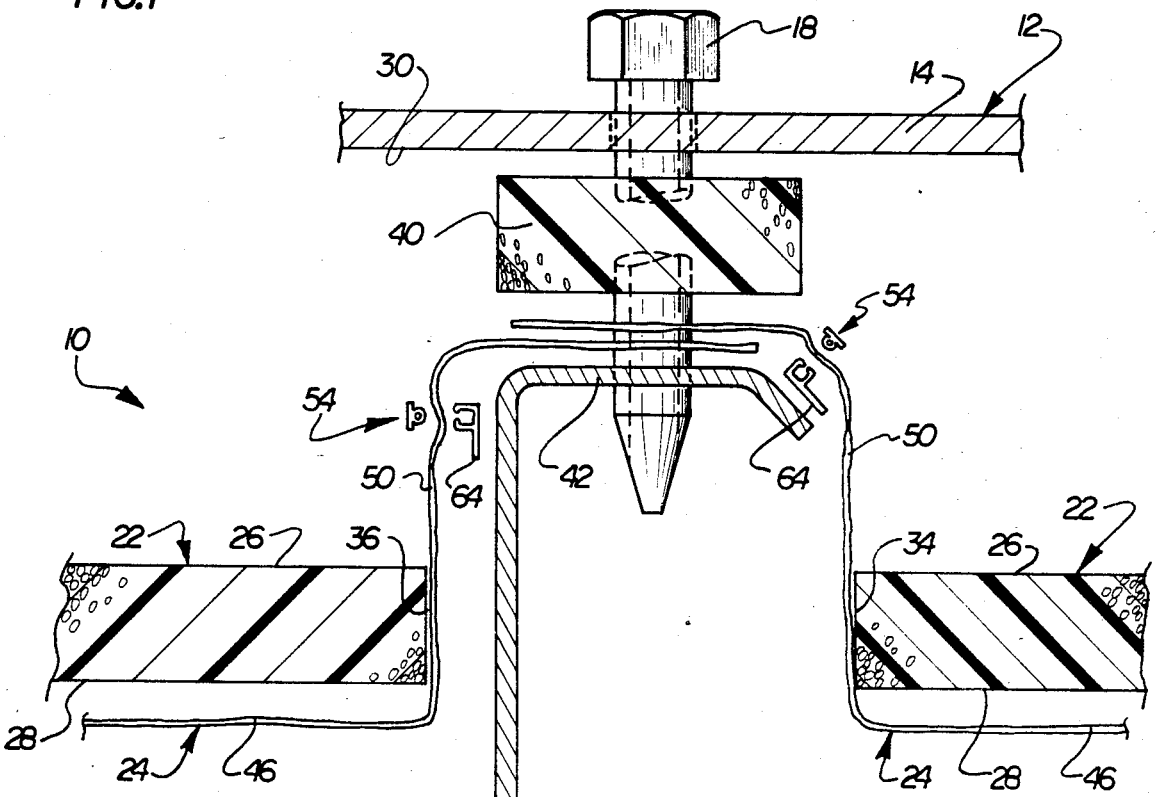
FIG. 2 is an enlarged exploded fragmentary sectional view illustrating the relationship between the insulation system and one of the purlins of FIG. 1.

In addition, each of the sheets 24 has a pair of longitudinally extending edge portions 50 (see FIGS. 1 and 2). The edge portions 50 project transversely outwardly from opposite edges 34 and 36 of an insulating board 22. The edge portions 50 of a sheet 24 extend throughout the length of an insulating board 22. The edge portions 50 of a sheet 24 are connected with the purlins 16 by connector assemblies 54 (see FIGS. 2 and 4) at locations above the upper side surface 26 of an insulating board 22.

Figure 3:
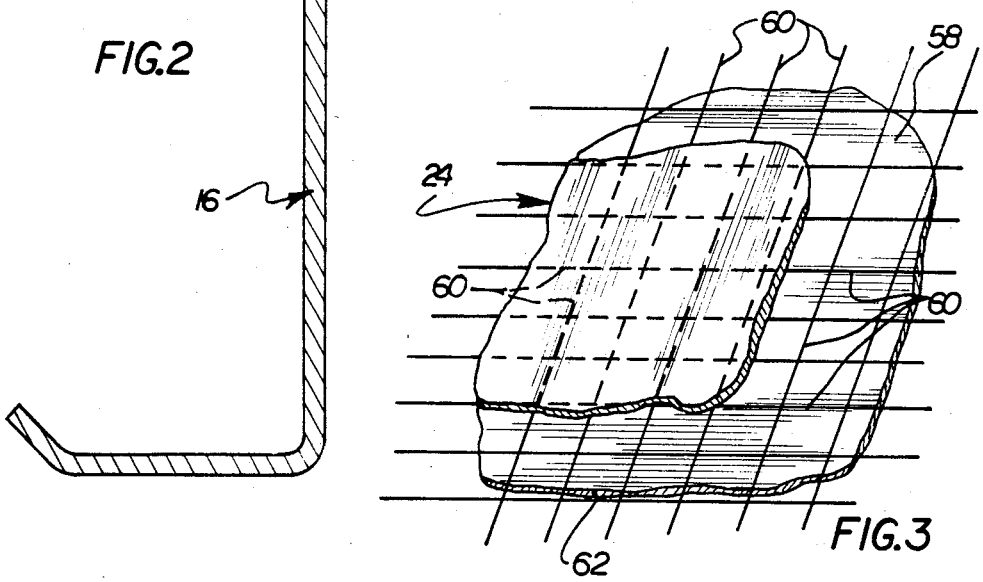
FIG. 3 is a fragmentary schematic view illustrating the construction of a flexible sheet which is used, in the insulation system of FIGS. 1 and 2, to suspend insulating boards benea roof panels.

It should be clear that the flexible sheets must have sufficient tensile strength to carry the weight of the insulation. Thus, the material of the flexible sheets may change. In the preferred embodiment, each of the flexible sheets 24 has a multi-layered construction. This multi-layered construction (see FIG. 3) includes a lower or bottom layer 58 with a white vinyl face which is turned downwardly. The vinyl bottom layer 58 forms a vapor barrier. An upper layer 62 formed of a metallized polyester film, is bonded to the lower layer 58. The upper layer 62 has a shiny upwardly facing surface which increases the insulating effect of the sheet 24.

A plurality of reinforcing threads 60 are disposed between the two layers 58 and 62 and extend throughout the length and width of the flexible sheet 24. Therefore, threads 60 extend between connector assemblies 54 on adjacent purlins 16 to reinforce the flexible sheet 24 and allow it to withstand the weight of the insulating boards 22 and any insulating material which may be placed above the insulating boards. The sheet 24 has a tensile strength of between 35 and 40 lbs./in. and a tear strength of 9 to 10 lbs. The sheet material 24 is sold by Alpha Associates, Inc., Two Ambay Avenue., Woodbridge, N.J., as Alpha-Temp (scrim base) Style VRP-3 triple ply laminate.

The connector assemblies 54 connect the edge portions 50 of the sheets 24 with the purlins 16. The specific construction of the connector asemblies may vary, as long as they perform the function of securing the vapor barrier to the purlins in a secure manner and hold the insulation in position. Preferably, each of the connector assemblies 54 includes a longitudinally extending support member 64 (see FIG. 5) which is secured to a purlin 16 by a body of adhesive 66. A longitudinally extending connector member 68 connects the support member 64 with the edge portion 50 of sheet of material 24.

Figure 4:
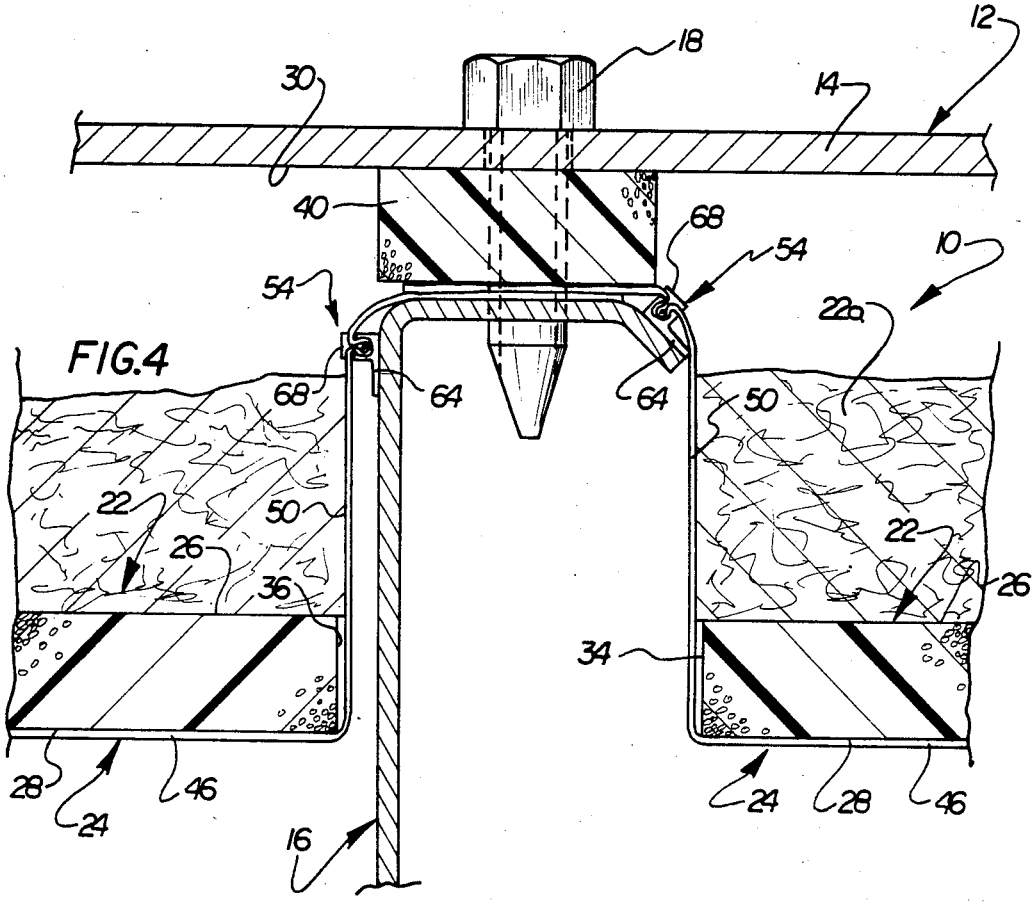
FIG. 4 a fragmentary sectional view, generally similar to FIG. 2, further illustrating the manner in which sheets are connected with a purlin to suspend insulating boards beneath a roof panel.
Figure 5:
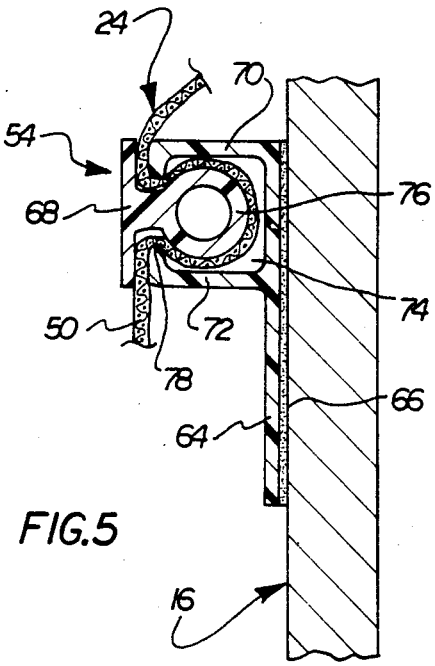
FIG. 5 an enlarged fragmentary sectional view of a connector assembly which connects the edge portion of a flexible of material with a purlin.

The support member 64 is disposed on the outer side of the sheet material 24, that is on a side opposite from the insulating board 22 (see FIGS. 4 and 5). The connector member 68 is disposed on the same side of the sheet 24 as the insulating board 22 and cooperates with the support member 64 to hold the sheet 24 against movement relative to the support member with a clamping action. Thus, a pair of longitudinally extending clamp arms 70 and 72 (FIG. 5) extend outwardly from the support member 64 and form a longitudinally extending cavity or recess 74 which extends throughout the length of the support member 64. A head end portion 76 of the connector member 68 is forced through an opening 78 between end portions of the connector arms 70 and 72 by resiliently deflecting the connector arms away from each other. This results in part of the edge portion 50 of the flexible sheet of material 24 being clamped between the connector member 68 and the support member 64.

Of course the clamping action between the support member 64 and connector member 68 could be obtained by providing the connector member with arms to form a recess into which a head portion or longitudinally extending bead on the support member is pressed. Although one specific type of connector assembly 54 has been shown in FIG. 5, it is contemplated that other types of connector assemblies could be used, if desired, to connect the sheet 24 with the purlins 16. For example, a Velcro strip could be used to connect the sheet 24 with the purlins 16. If this was done, one of the Velcro strips would be adhesively secured to a purlin 16 as a support member while the other Velcro strip would be connected to the sheet 24 as a connector member.

One of the advantages of the connector assembly 54 is that it is releasably connected with the edge portion 50 of the sheet 24. This enables the location of the connector assembly 54 to be adjusted to suspend the insulating boards 22 a desired distance beneath the roof panel 14. Thus, if the distance between the roof panel and the insulating boards is to be reduced, the connector member 68 is removed from the cavity 74 to release the clamping action on the edge portion 50 of the flexible sheet 24. The connector member 68 and support member 64 then clampingly engage the edge portion 50 of the sheet material at a location closer to the insulating board 22.

Since the longitudinally extending support member 64 is connected with the purlin 16 by the body of adhesive 66 at a location which is separate from the joint between the roof panel 14 and purlin 16, the insulation system 10 can be readily retrofitted into an existing metal building with or without existing insulation. This would be done by securing one edge portion 50 of the sheet to a purlin 16 with one connector assembly 54. A second connector assembly 54 would clampingly engage the opposite edge portion 50 of the sheet. The support member 64 of the second connector assembly 54 would then be connected with an adjacent purlin 16 while the connector assembly maintains a secure grip on the sheet material.

When the insulation system 10 is installed in a new building, it is contemplated that the sheets 24 will overlap the upper section 42 of the purlin 16 and be clamped in place by the insulating block 40 when the fasteners 18 are tightened. This results in the sheets 50 overlapping each other to form a continuous vapor barrier across the roof of the building.

Figure 6:
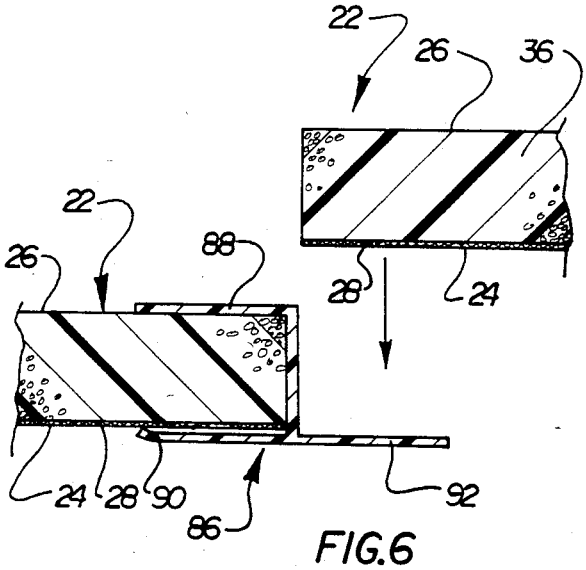
FIG. 6 a fragmentary sectional view of the manner in which transversely extending edge portions of insulating boards are interconnected.

The flexible sheets 24 have a length which is the same as the length of the insulating boards 22. It is contemplated that this length will probably be less than the length of the purlins 16. Therefore, it is necessary to suspend a plurality of insulating boards 22 between an adjacent pair of purlins 16 in order to insulate a longitudinally extending portion of the roof disposed between the purlins 16. A support bar 86 (see FIG. 6) is provided for interconnecting the end portions of the insulating boards 22.

The support bar 86 extends transversely to the longitudinal central axes of the purlins 16 and insulating boards 22. The insulating bar 86 has a pair of arms 88 and 90 which grip a transversely extending edge portion of an insulating board 22 and an edge portion of a sheet 24. The support bar 86 has a lip 92 which extends outwardly and supports an adjacent insulating board 22. The lip 92 supports the transversely extending edge portion of a second insulating board 22 and sheet 24. It should be understood that the support bar 86 extends perpendicular to the longitudinal central axis of the sheet 24 and has a length which is equal to the width of the insulating boards 22.

In view of the foregoing description, it is apparent that the present invention provides a new and improved insulation system 10 for the roof 12 of a metal building. The insulation system includes elongated insulating boards 22, which are suspended from the purlins 16 by flexible sheets 24 which form a vapor barrier. Additional insulation if desired can be laid and supported on the insulating boards 22. Such additional insulation is shown at 22*a* in FIG. 4. The flexible sheets 24 have widths which are greater than the width of the insulating boards 22 so that edge portions 50 of the sheets 24 extend outwardly from opposite sides 34 and 36 of the insulating boards 22. The edge portions 50 of the sheets 24 are connected with the purlins by a connector assemblies 54.

Each connector assembly 54 includes a support member 64 which is fixedly connected with the purlin 16 at a location above an insulating board 22. The support member 64 is disposed on a side of the sheet 24 opposite from the insulating board 22 to enable the support member 64 to be connected directly to a purlin 16. In one specific instance, the connector assembly 54 includes clamp arms 70 and 72 which cooperate with a connector member 68 to grip opposite sides of a sheet 24.

Having described one specific preferred embodiment of the invention, the following is claimed:

1. An insulation system for use in a building having a plurality of roof panels connected with longitudinally extending structural members, said insulation system comprising a body of insulating material, an elongated flexible sheet means forming a vapor barrier, said flexible sheet means having a central portion for supporting said body of insulating material beneath a roof panel and having first and second longitudinally extending edge portions projecting outwardly from opposite longitudinal edges of said body of insulating material for distances which are greater than the thickness of the body of insulating material, and connector means for releasably connecting the first and second edge portions of said flexible sheet means with a pair of adjacent structural members to thereby adjustably suspend said body of insulating material beneath a roof panel.

2. An insulation system as set forth in claim 1 wherein each of said connector means includes a longitudinally extending support member, means for connecting said support member to one of said first and second edge portions of said flexible sheet means with said support member spaced from and extending generally parallel to one edge portion of said body of insulating material and with said support member disposed on a side of said flexible sheet means opposite from a side of said flexible sheet means engaged by said body of insulating material, and means for connecting said support member to one of said structural members at a location above the one edge portion of said body of insulating material with the first edge portion of said flexible sheet means extending downwardly from said support member to the one edge portion of said body of insulating material.

3. An insulation system as set forth in claim 2 wherein said means for connecting said support member to one of said edge portions of said flexible sheet means includes clamp means for abuttingly engaging opposite sides of the one edge portion of said flexible sheet means, said clamp means including a first clamp element connected to said support member and disposed on the side of said flexible sheet means opposite from the side engaged by the body of insulating material and a second clamp element disposed on the side of said flexible sheet means engaged by the body of insulating material.

4. An insulation system as set forth in claim 3 wherein one of said clamp elements includes surface means for defining a recess in which the other one of said clamp elements is at least partially disposed.

5. An insulation system as set forth in claim 1 wherein said means for connecting said support member to one of said structural members includes a body of adhesive material.

6. An insulation system as set forth in claim 1 wherein said support member is connected to one of said structural members at a location separate from a connection between the roof panel and the one structural member.

7. An insulation system as set forth in claim 1 wherein said body of insulating material is rigid and imparts a generally flat configuration to the central portion of said flexible sheet means.

8. An insulation system as set forth in claim 1 wherein said body of insulating material is spaced from the roof panel.

9. An insulation system as defined in claim 1 wherein said first and second edge portions of said flexible sheet means extend beyond said body of insulating material for distances which are greater than the thickness of the body of insulating material.

10. An insulation system as set forth in claim 1 wherein said flexible sheet means includes a bottom layer that forms a vapor barrier and an upper layer.

11. An insulation system as set forth in claim 10 wherein said flexible sheet means further includes a plurality of reinforcing threads disposed between said bottom and upper layers and extending throughout the length and width of said flexible sheet means.

12. An insulation system as set forth in claim 10 wherein said upper layer is formed of a metallized plastic film bonded to said bottom layer.

* * * * *